United States Patent [19]

Gonzalez Martinez

[11] 3,947,969

[45] Apr. 6, 1976

[54] DRAWING INSTRUMENTS

[76] Inventor: Carlos Gonzalez Martinez, Plaza Fuensanta, No. 4, Murcia, Spain

[22] Filed: Dec. 14, 1973

[21] Appl. No.: 424,678

[30] Foreign Application Priority Data

Dec. 20, 1972 Spain ..... 409,846

[52] U.S. Cl. ..... 33/174 B; 33/174 G; 33/1 N

[51] Int. Cl.[2] ..... B44D 3/30

[58] Field of Search ..... 33/174 B, 174 G, 78, 78 R, 33/1 N

[56] References Cited

UNITED STATES PATENTS 3,393,457 7/1968 Freda ..... 33/78

3,568,327 3/1971 Furuoka ..... 33/174 B

*Primary Examiner*—Richard E. Aegerter
*Assistant Examiner*—Willis Little
*Attorney, Agent, or Firm*—Kenneth H. Murray

[57] ABSTRACT

A drawing instrument having a template which can be moved linearly or rotated. The template is circular in configuration and is held at its periphery by bearings mounted on a support under the template so that the template can be rotated without lateral movements.

5 Claims, 7 Drawing Figures

DRAWING INSTRUMENTS

BACKGROUND OF THE INVENTION

Templates are often used for drawing geometrical figures and other figures such as standardized symbols and letters. They are essentially thin flat plates with perforations which correspond to the figure to be drawn. The template is moved over the work and positioned so that it can be used to draw the desired figure.

It is often necessary to draw several signs or figures which are positioned about the circumference of a circle or to arrange the symbols so that they are arranged on concentric circles.

In the past it has been necessary to draw circles and position the templates with respect to the circumferences thereof. After the symbols have been drawn, the circumferences are erased.

Such a drafting procedure has several drawbacks. For one, it is time consuming. Further, it is difficult to arrange the symbols accurately. Lastly, when erasing the circles which were drawn in order to position the template, a portion of the symbol is often inadvertantly erased.

SUMMARY OF THE INVENTION

It is an object of the present invention to overcome drawbacks found in the prior art such as those discussed above. Accordingly, a drawing instrument is provided with a support having a circular opening and bearings about the periphery of said openings and a template which can be positioned within said bearings and engaging said bearings at its periphery so that said support and said template can be moved laterally and said template can be rotated with respect to said support.

DETAILED DESCRIPTION OF THE PREFERRED EMBODIMENT

Figure 1:
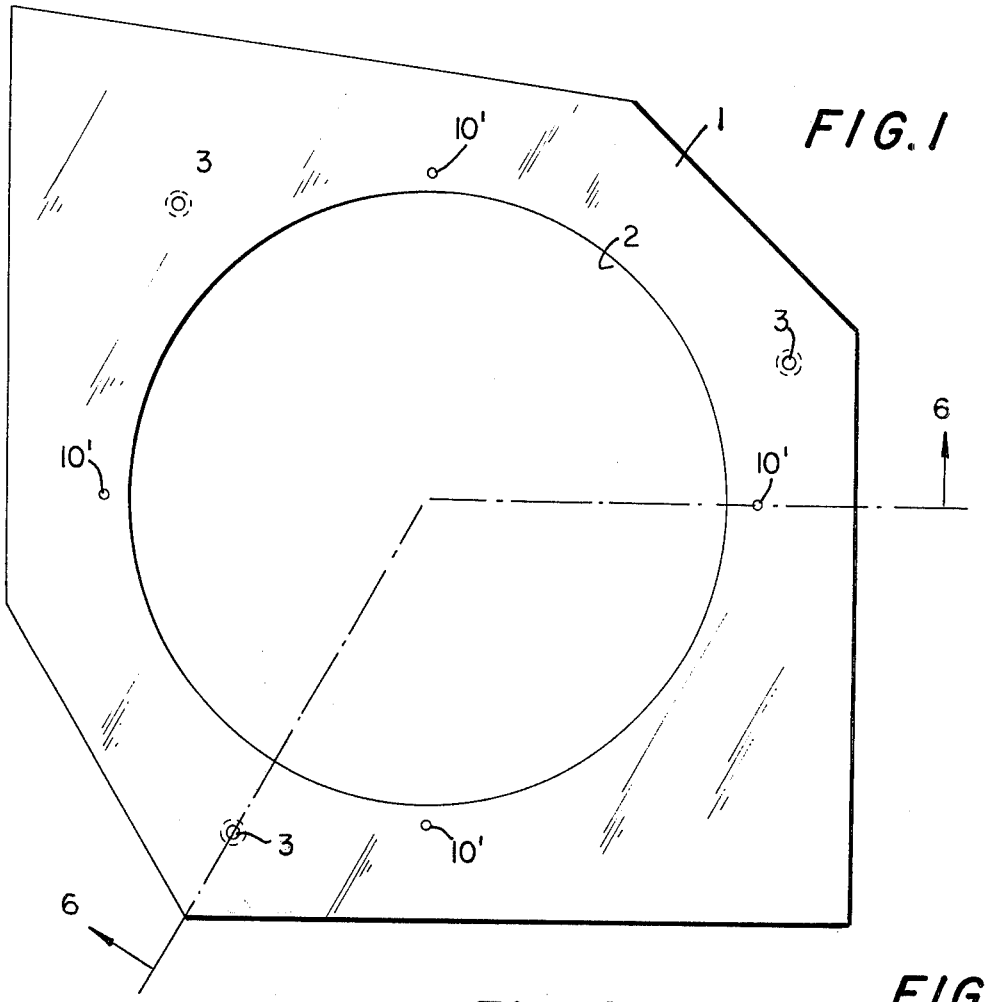
FIG. 1 is a plan view of the support of the present drawing instrument.

FIG. 1 shows in plan a polygonal support 1 with a central circular opening 2. Several bearings 3 are spaced about the opening 2 and are each an equal distance from the periphery thereof.

Figure 2:
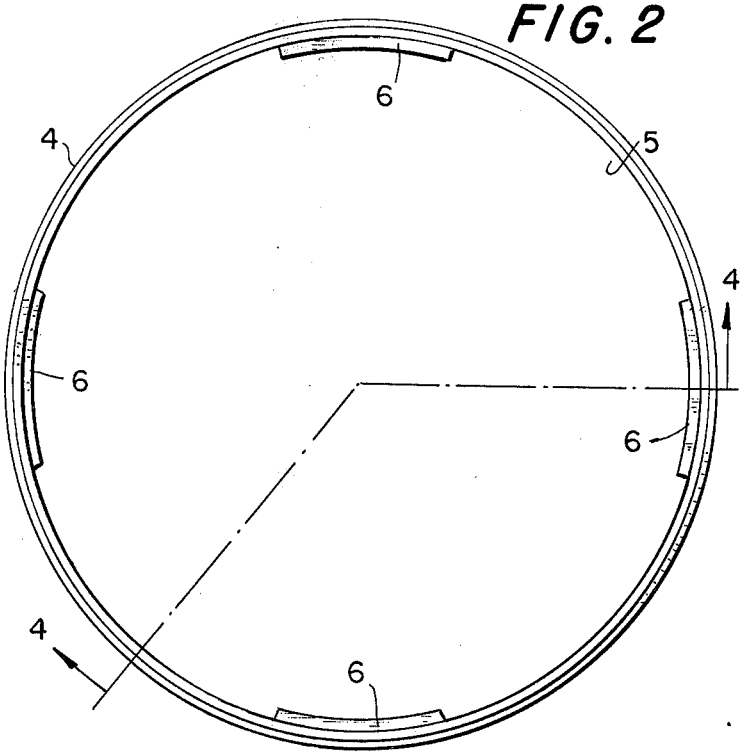
FIG. 2 is a plan view of a ring used in the present invention.

FIG. 2 shows a ring 4 which has a central circular opening 5 and which is provided with a number of offsets 6 which extend inwardly from the ring 4.

Figure 3:
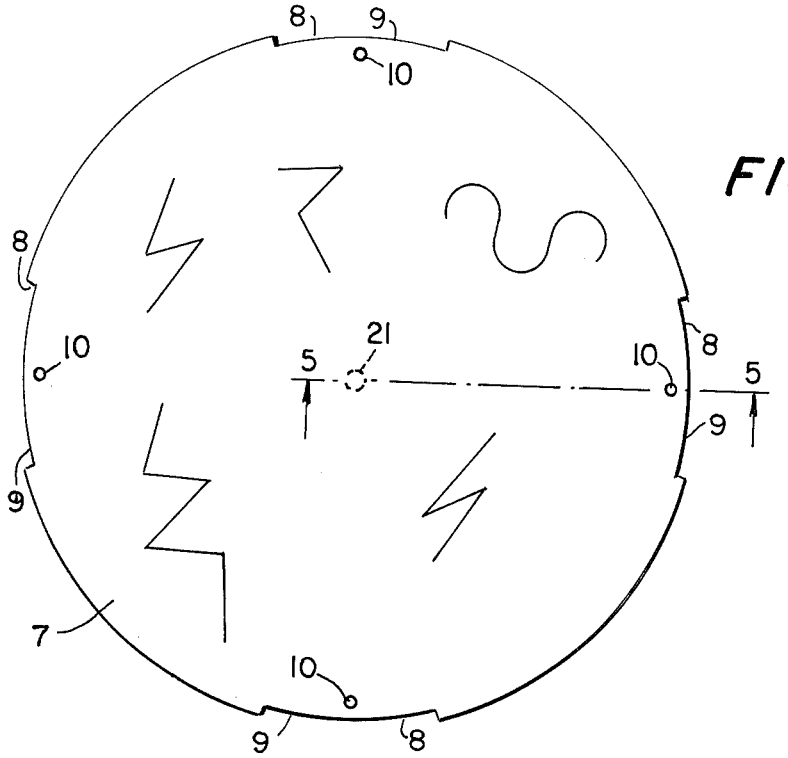
FIG. 3 is a plan view of a template used in the present invention.
Figure 5:
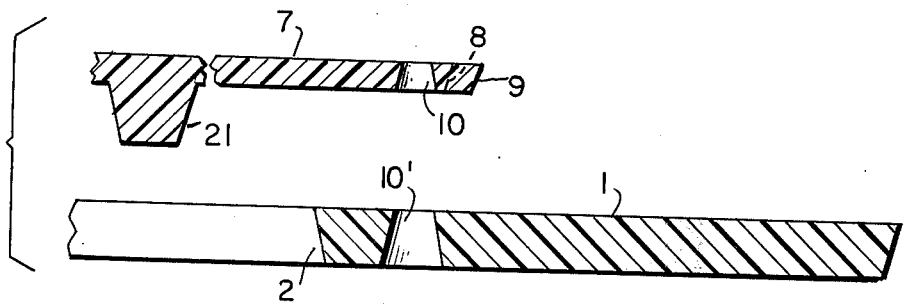
FIG. 5 is a view substantially in section taken substantially along the line 5—5 of FIG. 3 with a portion of the support of FIG. 1 added.

FIG. 3 shows a circular template 7 which has about its periphery a series of notches 8. The notches are curved along their length as at 9. Located inward of each notch is a hole 10. Extending through the support 1 are a number of holes 10′ which are spaced so that when the template is placed over the circular opening 2 in the support 1 the holes 10′ will be aligned with the holes 10 in the template 7.

Figure 6:
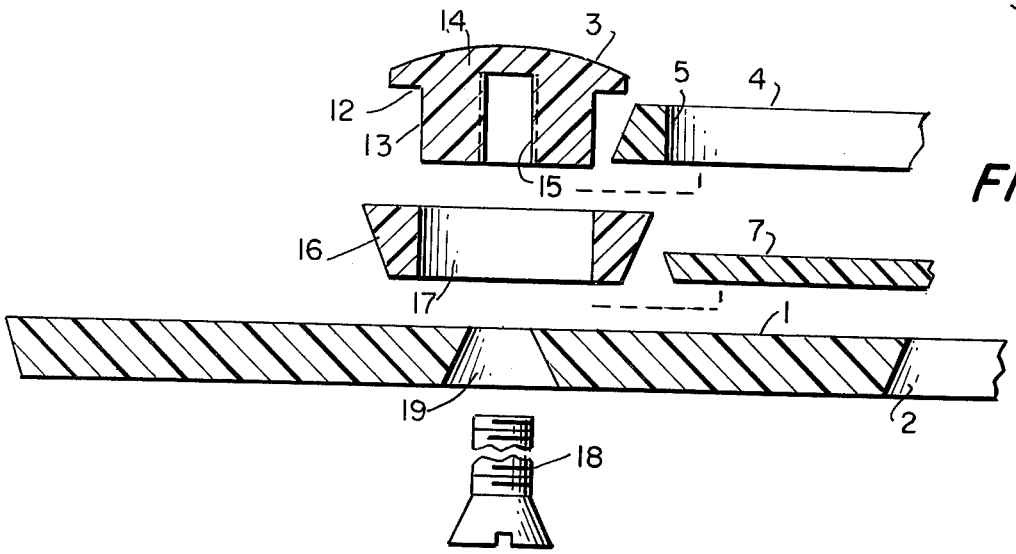
FIG. 6 is a view of a bearing used in the present invention.

FIG. 6 shows one of the bearings 3 in some detail with the parts thereof disassembled. Each of the bearings 3 includes a cap 12 having a cylindrical portion 13 and an upper flanged portion 14 of greater diameter than the cylindrical portion 13. A threaded hole 15 extends axially through the cylindrical portion 13. A rim 16 in the shape of a truncated cone encircles the cylindrical portion 13. The rim 16 has a circular hole 17 through which a screw 18 can extend when threaded through the hole 15 to hold the cap 12 on the support 1.

Figure 4:
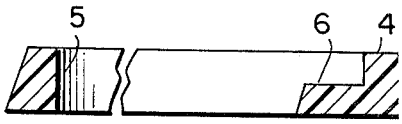
FIG. 4 is a view partly in section taken substantially along the line 4—4 of FIG. 2.

The drawing instrument is assembled by placing the ring 4 about the periphery of the template 7 so that each of the offsets 6 extends through one of the peripheral notches 8. Thereafter, the ring 4 and the template 7 are placed over the support 1 and the bearings 3 are assembled and screwed onto the support 1. The ring 4 has an outer edge which is not vertical but which slopes downward and outward as shown in FIG. 4. This outer edge engages the downward and inward sloping periphery of the rim 16. Thus, the ring 4 and its associated template do not ride upward when they are rotated because the rim 16 of each bearing 3 can rotate about the cylindrical portion 13 of the cap 12 thereof. The rim 16 is held from upward movement by the flange 14 on the cap 12.

Figure 7:
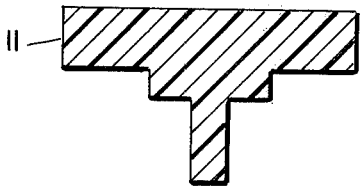
FIG. 7 is a view of a pin used in the present invention.

A pin 11 as the one shown in FIG. 7 can be positioned so that it extends through aligned holes 10 and 10′ and thereby prevents rotation of the template 7 with respect to the support 1.

The support 1 is preferably polygonal in configuration. This has several advantages. For one, the sides can be used as straight edges extending at different angles. Moreover, one or more of the sides can be engaged by a T-square or other vertical or horizontal extending straight edges to allow the present drawing instrument to be moved linearly without it becoming angularly disoriented.

Preferably the present template 7 has a downwardly extending central hub portion 21 which engages against the top of the work to maintain the template 7 at the proper height and prevent it from moving vertically with respect to the ring 4.

The foregoing describes but one preferred embodiment of the present invention, other embodiments being possible without exceeding the scope thereof as defined in the following claims.

What is claimed is:

1. A drawing instrument comprising a planar support having a circular opening therein, a plurality of rotatable bearing means, means detachably securing said bearing means to said support in circumferentially spaced relation about said circular opening, a drafting template peripherally supported by said planar support, said template having a dimension slightly greater than said support opening for reception thereover and within said bearing means, circular means surrounding and engaging the periphery of said template, said circular means further peripherally engaging said rotatable bearing means enabling the rotation of said template within said bearings for desired positioning thereof, and means provided on said circular means to prevent relative rotation of said template with respect to said circular means.

2. The drawing instrument of claim 1 wherein said circular means comprises a ring within which said template is received, the outer periphery of said ring being disposed in rotatable engagement with said rotatable bearing means, and interengaging notch and offset means on said template and ring to prevent relative rotation therebetween.

3. The drawing instrument of claim 2 including a plurality of holes disposed respectively in said template and said support capable of being rotated into vertical alignment, and a pin receivable in said aligned holes to lock said template against rotation with respect to said support.

4. The drawing instrument of claim 1 wherein said template includes a downwardly extending hub substantially centrally thereof extending through said support opening and disposed in said support opening thereby to support the central portion of said template while the periphery of the template is supported around the outside of said opening in said support.

5. The drawing instrument of claim 1 wherein said rotatable bearing means includes a downwardly and radially inwardly tapered peripheral surface cooperating with an upwardly and inwardly tapered peripheral surface on said template surrounding means thereby to releasably retain the template surrounding means on said support.

* * * * *